US006061457A

United States Patent [19]

Stockhamer

[11] Patent Number: 6,061,457

[45] Date of Patent: May 9, 2000

[54] WATERPROOF MICROPHONE AND SPEAKER

[76] Inventor: Lee Stockhamer, 1788 Horton Rd., Mohegan Lake, N.Y. 10547

[21] Appl. No.: 09/255,541

[22] Filed: Feb. 22, 1999

[51] Int. Cl.[7] ..... H04R 3/00

[52] U.S. Cl. ..... 381/111; 381/91; 381/122; 381/355; 367/140; 367/188

[58] Field of Search ..... 381/91, 122, 367, 381/361, 362, 355, 77, 334, 104, 109, 111, 112, 113, 114, 115; 181/149; 367/140, 162, 167, 172, 176, 188

[56] References Cited

U.S. PATENT DOCUMENTS 4,013,922 3/1977 Dewberry et al. .
5,277,179 1/1994 Stone .
5,627,802 5/1997 Langer ..... 367/188
5,701,355 12/1997 Brannan .
5,825,718 10/1998 Ueki et al. .
5,828,761 10/1998 Langer ..... 381/0

*Primary Examiner*—Minsun Oh Harvey

[57] ABSTRACT

A waterproof microphone and speaker (10) having a waterproof handle (12). A waterproof microphone (14) is securely attached to a top end of the handle (12). At least one microchip (16) is contained within the handle (12). The microphone (14) is electrically connected to the at least one microchip (16). A battery (18) is contained within the handle (12). The battery (18) is electrically connected to the at least one microchip (16). A waterproof ON/OFF control (20) is contained within the handle (12). The ON/OFF control (20) is electrically connected to the at least one microchip (16). A waterproof volume control (22) is contained within the handle (12). The volume control (22) is electrically connected to the at least one microchip (16). A waterproof speaker (28) is contained within the handle (12). The speaker (28) is electrically connected to the at least one microchip (16).

10 Claims, 5 Drawing Sheets

ASSEMBLED VIEW

WATERPROOF MICROPHONE AND SPEAKER

BACKGROUND OF THE INVENTION

1. Field of the Invention

The present invention relates to waterproof microphones. More particularly, the present invention relates to waterproof microphones and waterproof speakers.

2. Description of the Prior Art

Waterproof microphones and waterproof speakers are well known in the art. However, the novelty of this invention is a combination of both a waterproof microphone and speaker in one ergodynamically designed housing for the purpose of singing in the shower.

Numerous innovations for microphone have been provided in the prior art that are described as follows. Even though these innovations may be suitable for the specific individual purposes to which they address, they differ from the present invention as hereinafter contrasted.

In U.S. Pat. No. 5,828,761, titled Sound Amplification System Having a Submersible Microphone, invented by Alexander G. Langer, a sound amplification system is described includes an amplifier and a waterproof microphone. In an exemplary embodiment the microphone includes a transducer within a cavity covered by a resilient waterproof membrane. The system can monitor either the complete frequency range of the microphone or only one or more selected frequency ranges. The system can include one or more noise emitting lures that produce sound in a frequency range corresponding to the one or more selected frequency ranges. The invention also includes a method of waterproofing a miniature microphone.

The patented invention differs from the present invention because the patented invention is a sound amplification system which includes an amplifier and a waterproof microphone. The microphone is separated from the amplifier by a distance which is bridged by wires. The microphone includes a transducer within a cavity covered by a resilient waterproof membrane. The system can include one or more noise emitting lures that produce sound in a frequency range corresponding to the one or more selected frequency ranges. The invention also includes a method of waterproofing a miniature microphone. The present invention includes a microphone, a speaker, an amplifier, a power source contained with in a housing having a upper portion and a lower portion removably and securely attached by an attachment means which has a water proof seal. The housing further has a microphone interface which functions to permit sound to transmit through the case. The housing further has a speaker interface which functions to permit sound to transmit through the case. A volume switch functions to adjust the out put level. An ON/OFF switch functions to control the power source.

In U.S. Pat. No. 5,825,718, titled Underwater Communication Apparatus and Underwater Microphone Closed-type Sound Converter, invented by Masataka Ueki, Shouzou Kimura; and Masaharu Ueki, an underwater communication apparatus is provided which enables safe and clear speech transmission. The patented invention includes an exhalation pipe which defines an acoustic space which is attached to an interior space of a mouthpiece which is connected at one end to a site adjacent a breathing port of the mouthpiece. An exhaust valve which allows the flow of air only from the mouthpiece toward an exhaust port of the exhalation pipe is provided adjacent the exhaust port. A sound receiver portion having a capacitor microphone is provided within the exhalation pipe at a site upstream of the exhaust valve. When voice is uttered while the mouthpiece is held in the mouth, exhaled air is emitted from the exhaust port through the exhalation pipe and the exhaust valve, so that the capacitor microphone is less liable to noise trouble due to bubbles produced at the exhaust port, or on the downstream side. Speech transmission is made underwater by a waterproof speaker on the basis of an output of the capacitor microphone.

The patented invention differs from the present invention because the patented invention is an underwater communication apparatus which is positioned with in the breathing apparatus of a aqualung. The patented invention provides safe and clear speech transmission from the user to the microphone. The patented invention includes an exhalation pipe which defines an acoustic space which is attached to an interior space of a mouthpiece which is connected at one end to a site adjacent a breathing port of the mouthpiece. An exhaust valve which allows the flow of air only from the mouthpiece toward an exhaust port of the exhalation pipe is provided adjacent the exhaust port. A sound receiver portion having a capacitor microphone is provided within the exhalation pipe at a site upstream of the exhaust valve. When voice is uttered while the mouthpiece is held in the mouth, exhaled air is emitted from the exhaust port through the exhalation pipe and the exhaust valve, so that the capacitor microphone is less liable to noise trouble due to bubbles produced at the exhaust port, or on the downstream side. Speech transmission is made underwater by a waterproof speaker on the basis of an output of the capacitor microphone. The present invention is hand held and includes a microphone, speaker and amplifier in a housing. The present invention is waterproof.

In U.S. Pat. No. 5,701,355, titled Microphone for a Two Way Radio, invented by Michael H. Brannan, Jorge Luis Garcia, and Masaru Tokiyama, a microphone for a two-way radio is described.

The patented invention differs from the present invention because the patented invention is a microphone for a two-way radio. The patented invention lacks an amplifier and a power source. The patented invention has waterproof housing The patented invention lacks a speaker, an amplifier, and a power source contained with in the housing The patented invention farther lacks a speaker interface which functions to permit sound to transmit through the case and a volume switch which functions to adjust the out put level.

In U.S. Pat. No. 5,627,802, titled Sound Amplification System Having a Submersible Microphone, invented by Alexander G. Langer, a sound amplification system includes an amplifier and a waterproof microphone. In an exemplary embodiment the microphone includes a transducer within a cavity covered by a resilient waterproof membrane. The system can monitor either the complete frequency range of the microphone or only one or more selected frequency ranges. The system can include one or more noise emitting lures that produce sound in a frequency range corresponding to the one or more selected frequency ranges. The invention also includes a method of waterproofing a miniature microphone. A housing can be provided for the microphone to protect it and to reduce background noise caused by turbulence during towing. The housing has a streamlined shape and can be weighted. One or more fins can be provided to stabilize the housing.

The patented invention differs from the present invention because the patented invention is a sound amplification system which includes an amplifier and a waterproof microphone. The microphone is separated from the amplifier by a distance which is bridged by wires. The microphone includes a transducer within a cavity covered by a resilient waterproof membrane. The system can include one or more noise emitting lures that produce sound in a frequency range corresponding to the one or more selected frequency ranges. The invention also includes a method of waterproofing a miniature microphone. A housing can be provided for the microphone to protect it and to reduce background noise caused by turbulence during towing. The housing has a streamlined shape and can be weighted. One or more fins can be provided to stabilize the housing. The present invention includes a microphone, a speaker, an amplifier, a power source contained with in a housing having a upper portion and a lower portion removably and securely attached by an attachment means which has a water proof seal. The housing further has a microphone interface which functions to permit sound to transmit through the case. The housing further has a speaker interface which functions to permit sound to transmit through the case. A volume switch functions to adjust the out put level. An ON/OFF switch functions to control the power source.

In U.S. Pat. No. 5,277,179, titled Diver's Microphone Mask, invented by Mark Stone and Soren Uhre, a microphone mask to be worn in front of the mouth of an underwater diver has a microphone assembly and a teethpiece assembly mounted in a rubber waterproof enclosure. The enclosure has an air passage extending from an inlet opening to a rear outlet opening. The teethpiece assembly includes a plastic insert with a vertical plate mounted in the enclosure. The vertical plate has openings for the air passage as well as to allow sound to travel from the diver's mouth to the microphone assembly. A teeth member extends rearwardly out of the outlet opening into the diver's mouth where it is held between the diver's teeth. The teeth member is connected to the insert by resilient spring members which draw the enclosure rearwardly against the diver's face. There is a sealing surface around the outlet opening, and this seals it around the outside of the diver's mouth. This eliminates the need for a headband and facilitates the use of the microphone mask for the combination of breathing and speaking.

The patented invention differs from the present invention because the patented invention is a microphone mask to be worn in front of the mouth of an underwater diver has a microphone assembly and a teethpiece assembly mounted in a rubber waterproof enclosure. The patented invention lacks features similar to the present invention.

In U.S. Pat. No. 4,013,992, titled Diver's Piezoelectric Microphone with Integral Agc Preamplifier, invented by Larry F. Dewberry, Robert H. Banks and Clell A. Dildy, an improved microphone assembly for use in a diver's mask or helmet and is characterized by a substantially flat frequency response at pressures from 1 to 30 or more atmospheres of breathing gas. A silicone rubber coated piezoelectric diaphragm is mounted by its periphery in a cylindrical housing with both sides of the diaphragm exposed to ambient gas pressures. A ground plate is mounted in said housing with one side in spaced relation to the diaphragm and having on the other side thereof a preamplifier and automatic gain control circuit electrically connected to the diaphragm and encased in waterproof potting compound.

The patented invention differs from the present invention because the patented invention is an improved microphone assembly for use in a diver's mask or helmet. The patented invention is characterized by a substantially flat frequency response at pressures from 1 to 30 or more atmospheres of breathing gas. The patented invention lacks a speaker and a hand held housing which contains a power source.

Numerous innovations for microphones have been provided in the prior art that are adapted to be used. Even though these innovations may be suitable for the specific individual purposes to which they address, they would not be suitable for the purposes of the present invention as heretofore described.

SUMMARY OF THE INVENTION

The types of problems encountered in the prior art are microphones and speakers were always separated and not one unit.

In the prior art, unsucessful attempts to solve this problem were attempted namely: in the scuba industry for underwater communication. However, the problem was solved by the present invention because the present invention is a hand held microphone/speaker which resembles a microphone for performing on stage.

Innovations within the prior art are rapidly being exploited in the field of novelty items.

The present invention went contrary to the teaching of the art which describes and claims underwater apparatuses.

The present invention solved a long felt need for a simple waterproof hand held microphone/speaker combination for practicing singing in the shower where the acoustics are best.

Accordingly, it is an object of the present invention to provide a waterproof microphone and speaker having a handle, microphone, microchip, battery, ON/OFF control, volume control, instrument selection button, rhythm selection button, speaker, ergodynamic handle cover, handle holder, and goose neck.

More particularly, it is an object of the present invention to provide the handle having a handle eyelet.

In keeping with these objects, and with others which will become apparent hereinafter, one feature of the present invention resides, briefly stated, in the ergodynamic handle cover ergodynamic handle cover plateaus, ergodynamic handle cover valley, ergodynamic handle cover ON/OFF control cutout, ergodynamic handle cover volume control cutout, ergodynamic handle cover instrument selection button cutout, and ergodynamic handle cover rhythm selection button cutout.

When the handle holder is designed in accordance with the present invention, it comprises a handle holder cradle and a handle holder suction cup.

In accordance with another feature of the present invention, the goose neck comprises a goose neck pipe attachment and a goose neck eyelet attachment.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1:
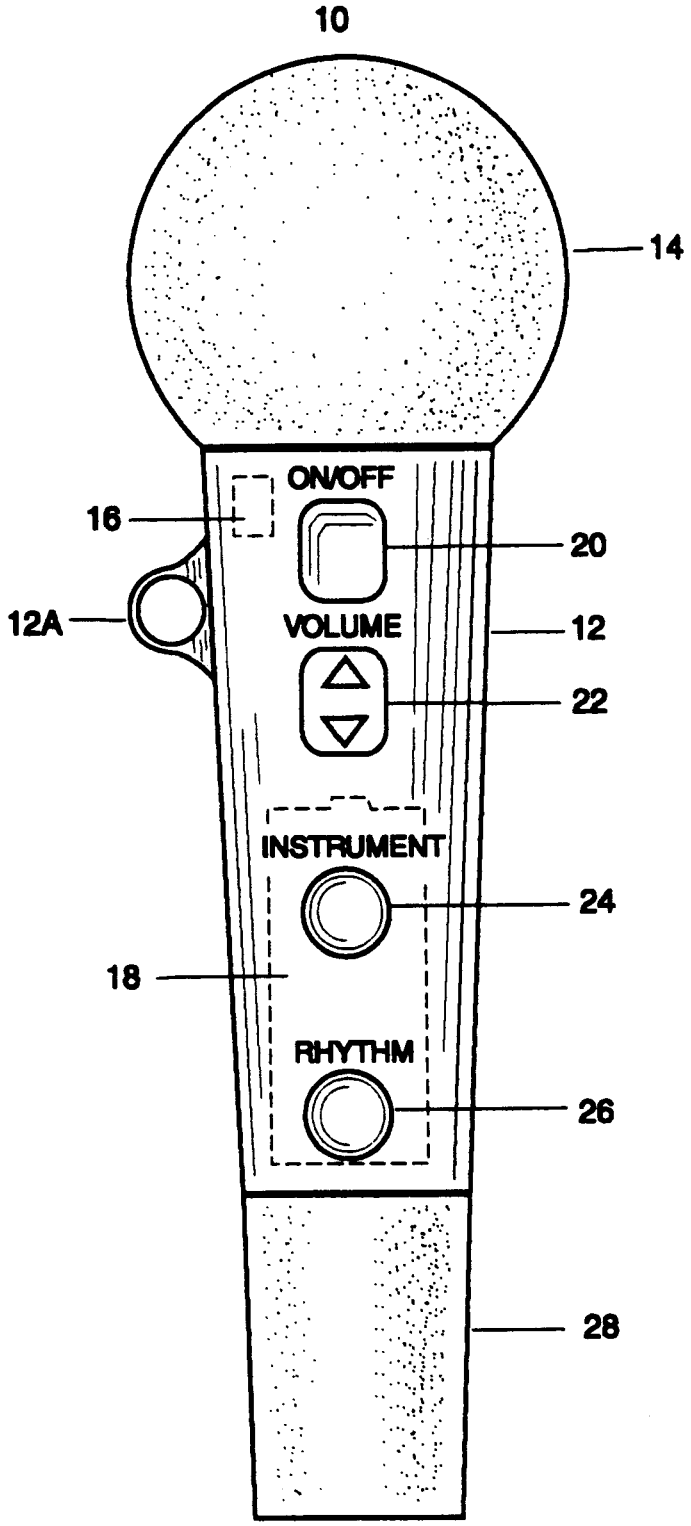
FIG. 1 is a front view of a waterproof microphone and speaker (10).
Figure 4:
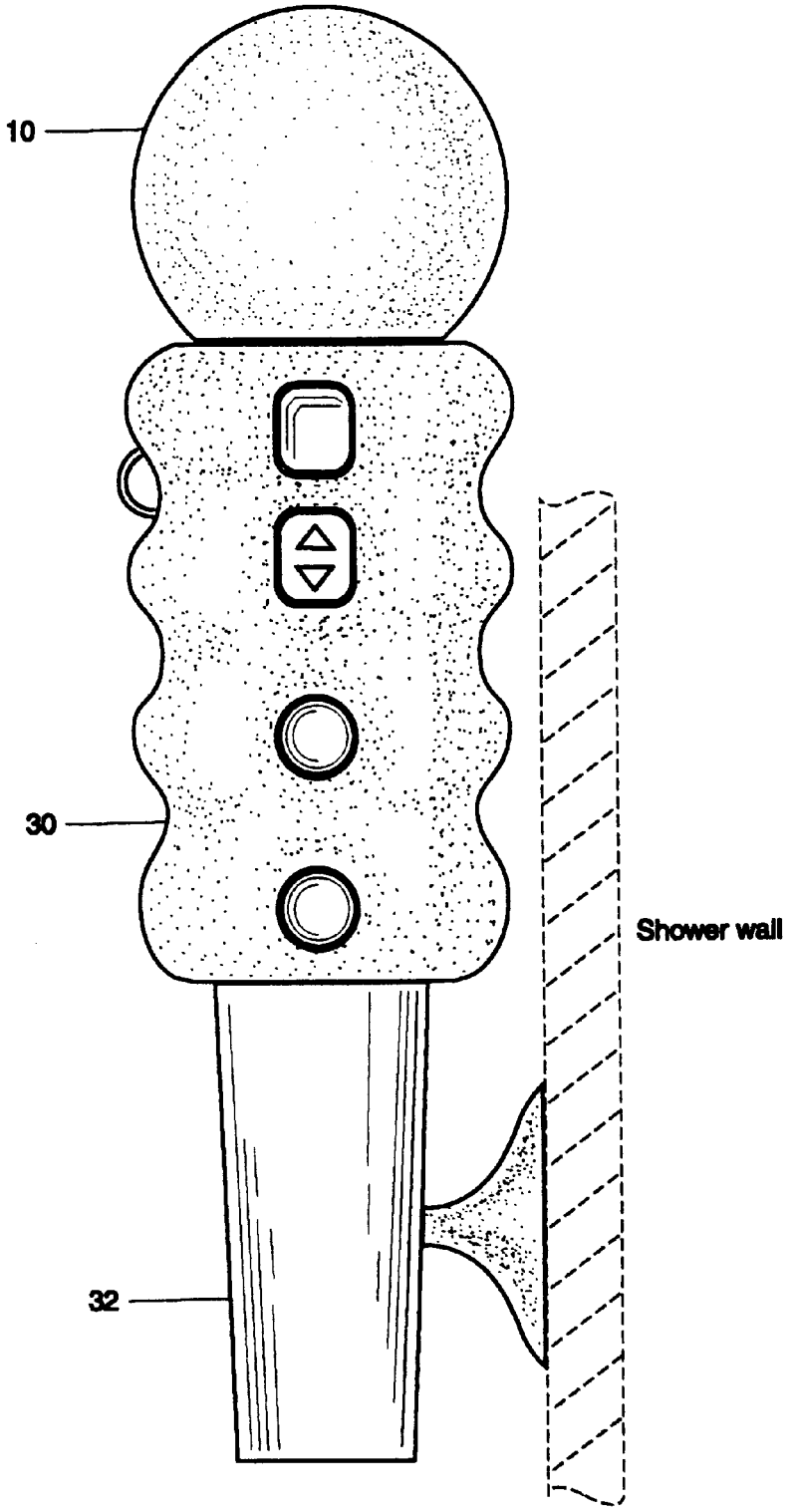
FIG. 4 is a front view of a waterproof microphone and speaker (10) with an ergodynamic handle cover (30) positioned in a handle holder (32).

Firstly, referring to FIG. 1 and FIG. 4 which are a front view of a waterproof microphone and speaker (10) comprising a waterproof handle (12) and a front view of a waterproof microphone and speaker (10) with an ergodynamic handle cover (30) positioned in a handle holder (32), respectively.

The waterproof microphone and speaker (10) further comprises a waterproof microphone (14) securely attached to a top end of the handle (12). The handle (12) comprises a handle eyelet (12A) securely fastened thereon, the handle eyelet (12A) functions as a securing means to hang the waterproof microphone and speaker (10) on a rope or string.

The waterproof microphone and speaker (10) further comprises at least one microchip (16) contained within the handle (12). The microphone (14) is electrically connected to the at least one microchip (16). The microchip (16) may optionally have noise reduction in the specific frequency of the noise shower water produces when emanating from a shower head.

The waterproof microphone and speaker (10) further comprises a battery (18) contained within the handle (12), the battery (18) is electrically connected to the at least one microchip (16).

The waterproof microphone and speaker (10) further comprises a waterproof ON/OFF control (20) contained within the handle (12), the ON/OFF control (20) is electrically connected to the at least one microchip (16).

The waterproof microphone and speaker (10) further comprises a waterproof volume control (22) contained within the handle (12). The volume control (22) is electrically connected to the at least one microchip (16).

The waterproof microphone and speaker (10) further comprises a waterproof speaker (28) contained within the handle (12). The speaker (28) is electrically connected to the at least one microchip (16).

The waterproof microphone and speaker (10) further comprises a waterproof rhythm selection button (26) contained within the handle (12). The rhythm selection button (26) is electrically connected to the at least one microchip (16).

The waterproof microphone and speaker (10) as described further comprises an instrument selection button (24) contained within the handle (12). The instrument selection button (24) is electrically connected to the at least one microchip (16).

Figure 2:
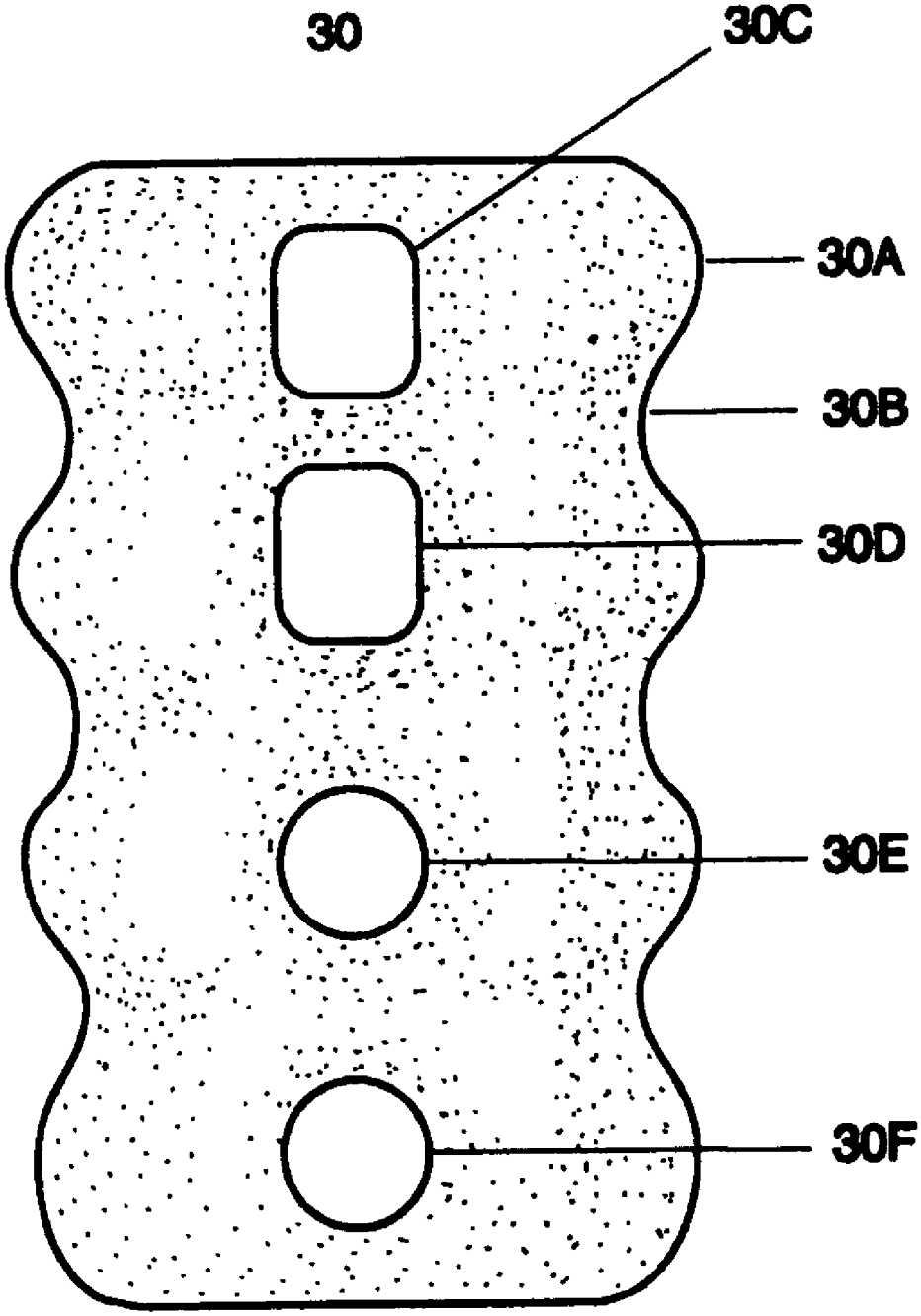
FIG. 2 is a front view of an ergonomic handle cover (30).

Referring to FIG. 2 which is a front view of an ergodynamic handle cover (30). The handle (12) further comprises an ergodynamic handle cover (30) having a complementary shape to the handle (12). The ergodynamic handle cover (30) comprises at least one ergodynamic handle cover plateau (30A) and at least one ergodynamic handle cover valley (30B) functioning as an anti-slip gripping means. The ergodynamic handle cover (30) further comprises an ergodynamic handle cover ON/OFF control cutout (30C) and an ergodynamic handle cover volume control cutout (30D). The ergodynamic handle cover (30) further comprises an ergodynamic handle cover instrument selection button cutout (30E). The ergodynamic handle cover (30) further comprises an ergodynamic handle cover rhythm selection button cutout (30F).

Figure 3:
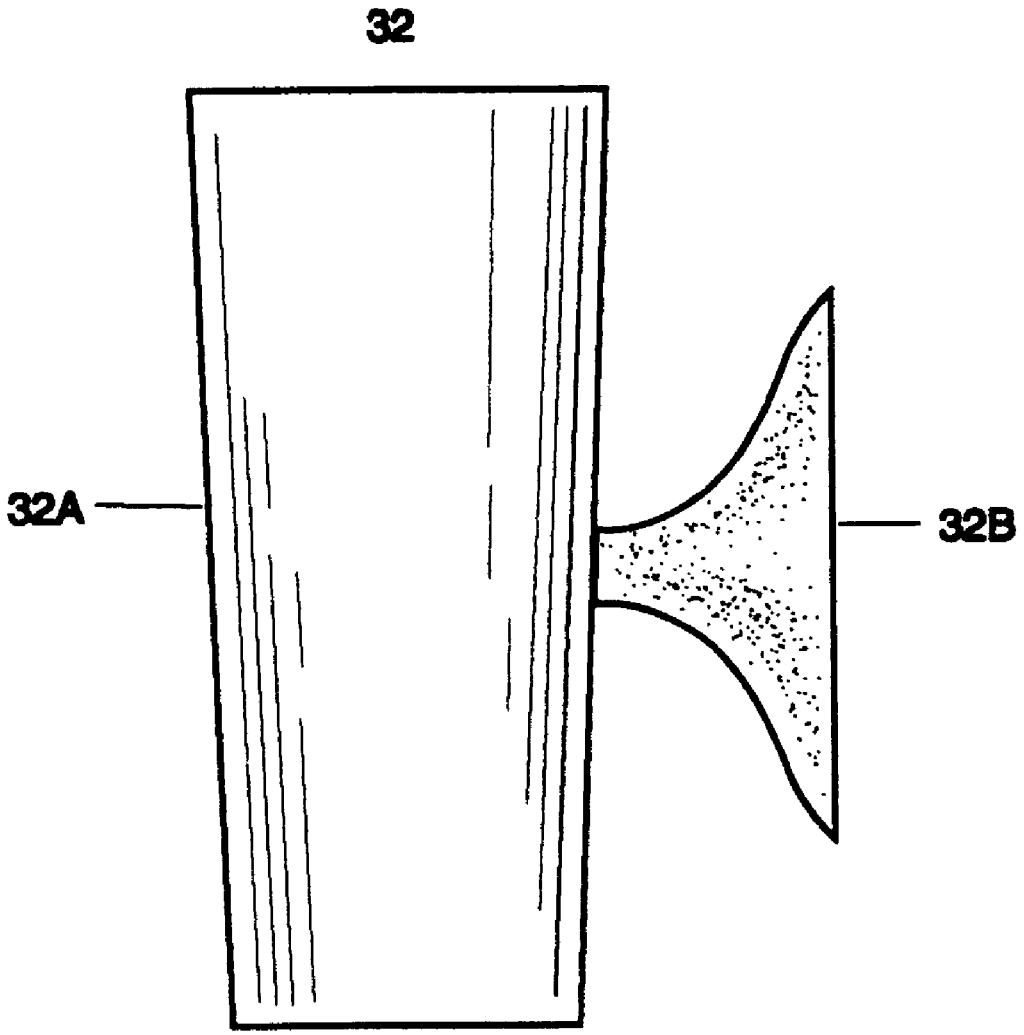
FIG. 3 is a side view of a handle holder (32).

Referring to FIG. 3 which is a side view of a handle holder (32). The waterproof microphone and speaker (10) further comprises a handle holder (32) which comprises a handle holder cradle (32A) in which the handle (12) is removably positioned. At least one handle holder suction cup (32B) is securely fastened to the handle holder cradle (32A) extending outwardly therefrom. The at least one handle holder suction cup (32B) functions as a securing means to attach the handle holder (32) to a flat surface or wall.

Figure 5:
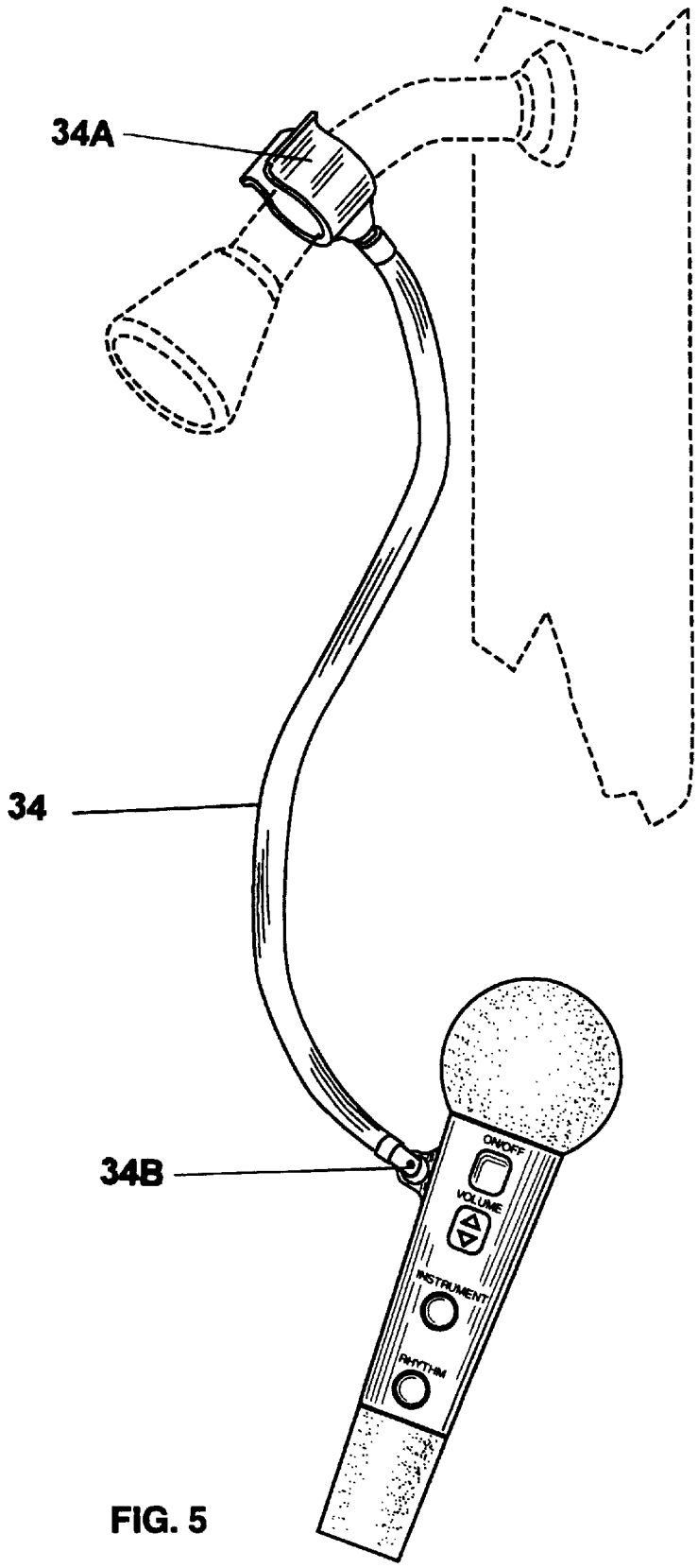
FIG. 5 is a front view of a waterproof microphone and speaker (10) attached to a goose neck (34).

Lastly, referring to FIG. 5 which is a front view of a waterproof microphone and speaker (10) attached to a goose neck (34) which comprises a goose neck pipe attachment (34A) attachable to a horizontal shower pipe emanating from the wall and a goose neck eyelet attachment (34B) attachable to the handle eyelet (12A). The goose neck (34) functions to hold the waterproof microphone and speaker (10) for hands-free singing.

It will be understood that each of the elements described above, or two or more together, may also find a useful application in other types of constructions differing from the type described above.

While the invention has been illustrated and described as embodied in a microphone, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so filly reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

LIST OF REFERENCE NUMERALS UTILIZED IN THE DRAWINGS

10—waterproof microphone and speaker (10)
12—handle (12)
12A—handle eyelet (12A)
14—microphone (14)
16—microchip (16)
18—battery (18)
20—on/off control (20)
22—volume control (22)
24—instrument selection button (24)
26—rhythm selection button (26)
28—speaker (28)
30—ergodynamic handle cover (30)
30A—ergodynamic handle cover plateau (30A)
30B—ergodynamic handle cover valley (30B)
30C—ergodynamic handle cover on/off control cutout (30C)
30D—ergodynamic handle cover volume control cutout (30D)
30E—ergodynamic handle cover instrument selection button cutout (30E)
30F—ergodynamic handle cover rhythm selection button cutout (30F)
32—handle holder (32)
32A—handle holder cradle (32A)

32B—handle holder suction cup (32B)
34—goose neck (34)
34A—goose neck pipe attachment (34A)
34B—goose neck eyelet attachment (34B)

What is claimed is:

1. A waterproof microphone and speaker (10) comprising:

A) a waterproof handle (12);

B) a waterproof microphone (14) securely attached to a top end of the handle (12);

C) at least one microchip (16) contained within the handle (12), the microphone (14) is electrically connected to the at least one microchip (16);

D) a battery (18) contained within the handle (12), the battery (18) is electrically connected to the at least one microchip (16);

E) a waterproof ON/OFF control (20) contained within the handle (12), the ON/OFF control (20) is electrically connected to the at least one microchip (16);

F) a waterproof volume control (22) contained within the handle (12), the volume control (22) is electrically connected to the at least one microchip (16); and G) a waterproof speaker (28) contained within the handle (12), the speaker (28) is electrically connected to the at least one microchip (16).

2. The waterproof microphone and speaker (10) as described in claim 1 further comprises a waterproof instrument selection button (24) contained within the handle (12), the instrument selection button (24) is electrically connected to the at least one microchip (16).

3. The waterproof microphone and speaker (10) as described in claim 1 further comprises a waterproof rhythm selection button (26) contained within the handle (12), the rhythm selection button (26) is electrically connected to the at least one microchip (16).

4. The waterproof microphone and speaker (10) as described in claim 1, wherein the handle (12) further comprises an ergodynamic handle cover (30) having a complementary shape to the handle (12), the ergodynamic handle cover (30) comprises at least one ergodynamic handle cover plateau (30A) and at least one ergodynamic handle cover valley (30B) functioning as an anti-slip gripping means, the ergodynamic handle cover (30) further comprises an ergodynamic handle cover ON/OFF control cutout (30C) and an ergodynamic handle cover volume control cutout (30D).

5. The waterproof microphone and speaker (10) as described in claim 4, wherein the ergodynamic handle cover (30) further comprises an ergodynamic handle cover instrument selection button cutout (30E).

6. The waterproof microphone and speaker (10) as described in claim 4, wherein the ergodynamic handle cover (30) further comprises an ergodynamic handle cover rhythm selection button cutout (30F).

7. The waterproof microphone and speaker (10) as described in claim 1, wherein the handle (12) comprises a handle eyelet (12A) securely fastened thereon, the handle eyelet (12A) functions as a securing means to hang the waterproof microphone and speaker (10) on a rope or string.

8. The waterproof microphone and speaker (10) as described in claim 1, further comprises a handle holder (32) which comprises a handle holder cradle (32A) in which the handle (12) is removably positioned, at least one handle holder suction cup (32B) is securely fastened to the handle holder cradle (32A) extending outwardly therefrom, the at least one handle holder suction cup (32B) functions as a securing means to attach the handle holder (32) to a flat surface or wall.

9. The waterproof microphone and speaker (10) as described in claim 1, wherein the microchip (16) comprises a noise reduction component in a frequency of the sound produced when pressurized water emanates from a showerhead.

10. The waterproof microphone and speaker (10) as described in claim 1 further comprises a goose neck (34) having a goose neck pipe attachment (34A) attachable to a shower pipe and a goose neck eyelet attachment (34B) attachable to the handle eyelet (12A).

* * * * *